US010315086B1

(12) United States Patent
Johnson

(10) Patent No.: US 10,315,086 B1
(45) Date of Patent: Jun. 11, 2019

(54) BASEBALL AND SOFTBALL SLIDE TRAINER

(71) Applicant: Edgar J. Johnson, North Wales, PA (US)

(72) Inventor: Edgar J. Johnson, North Wales, PA (US)

( * ) Notice: Subject to any disclaimer, the term of this patent is extended or adjusted under 35 U.S.C. 154(b) by 39 days.

(21) Appl. No.: 15/840,037

(22) Filed: Dec. 13, 2017

(51) Int. Cl.
*A63B 69/00* (2006.01)
*A63B 6/00* (2006.01)

(52) U.S. Cl.
CPC ..... *A63B 69/0013* (2013.01); *A63B 6/00* (2013.01); *A63B 69/00* (2013.01); *A63B 69/0002* (2013.01); *A63B 2069/0004* (2013.01)

(58) Field of Classification Search
CPC ..... A63B 69/0013; A63B 6/00; A63B 2069/0004; A63B 69/00; A63B 69/0002
USPC ..... 473/422, 451, 452; 472/117, 128, 116, 472/129; 434/247, 251, 252, 255; 482/51, 148, 253; D21/662, 686
See application file for complete search history.

(56) References Cited

U.S. PATENT DOCUMENTS 4,887,811 A 12/1989 Tresh
5,114,387 A * 5/1992 Keppler ..... A63B 21/4037 434/253
5,246,401 A 9/1993 Boatwright
5,326,338 A * 7/1994 Makous ..... A63B 69/0022 434/253
5,352,165 A * 10/1994 Koblick ..... A63B 22/20 434/253
D355,001 S * 1/1995 Koblick ..... A63B 21/4037 D21/686
5,813,925 A 9/1998 Lewy
6,142,879 A 11/2000 Phillips
6,692,257 B1 2/2004 Branum et al.
6,984,195 B1 * 1/2006 Phillips ..... A63B 26/003 482/51
7,001,282 B1 2/2006 Jennings
7,309,302 B1 12/2007 Phillips
10,076,695 B1 * 9/2018 Simon ..... A63B 69/0026 473/446
2014/0051531 A1 2/2014 Mazzocchi

OTHER PUBLICATIONS

Amazon.com Schutt Sports Slide Rite advertisement, accessed Dec. 13, 2017, https://www.amazon.com/Schutt-12911240-Sports-Slide-Rite/dp/B00120SE28, hard copy attached.

* cited by examiner

*Primary Examiner* — Mitra Aryanpour
(74) *Attorney, Agent, or Firm* — Robert J. Yarbrough; Lipton, Weinberger & Husick

(57) ABSTRACT

A slide trainer for a softball or baseball student features a resilient pad and a load-spreading member. The load-spreading member distributes the load of a student landing on the load-spreading member over a relatively large are and hence volume of the resilient pad. The resilient pad may be thinner and hence less bulky and less costly than a resilient pad without the load-spreading member. For embodiments where the load-spreading member is not covered by a fabric, the load-spreading member provides a relatively slippery surface on which the student may slide.

17 Claims, 10 Drawing Sheets

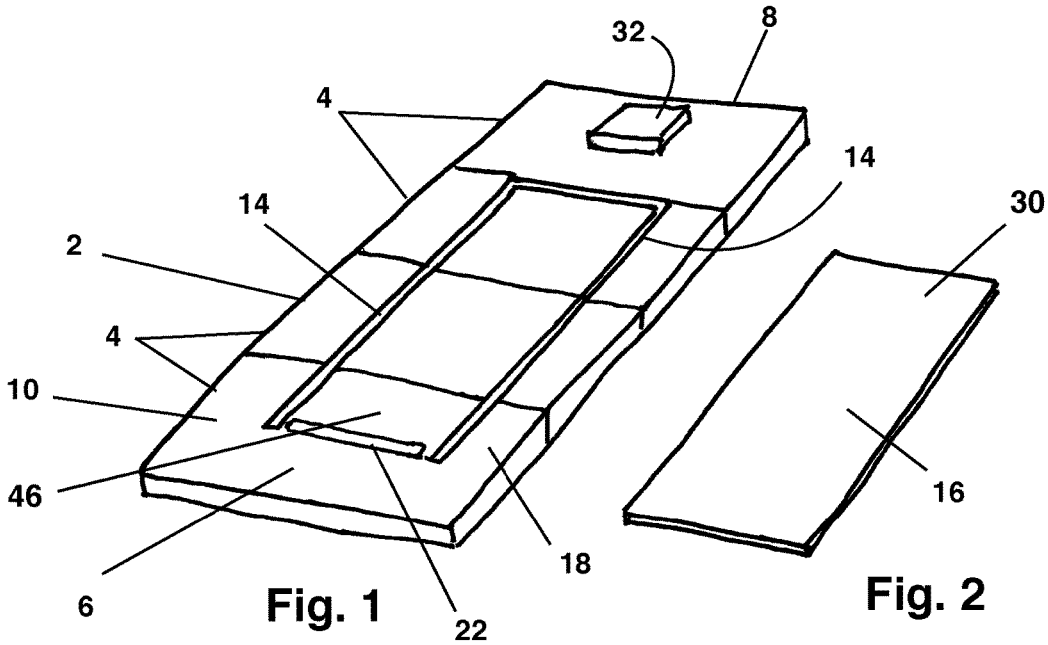
Fig. 1
Fig. 2
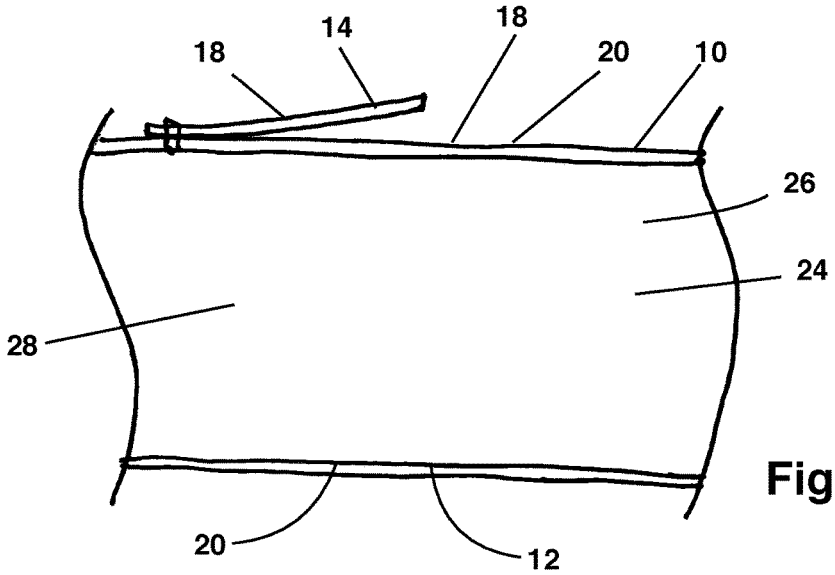
Fig. 3

BASEBALL AND SOFTBALL SLIDE TRAINER

I. BACKGROUND OF THE INVENTION

A. Field of the Invention

The Invention is an apparatus for training softball and baseball players in the proper technique for sliding into a base. The apparatus and method of the Invention allow a student softball or baseball player to overcome his or her fear of falling and fear of impact in a controlled, low-risk environment while learning the skills required to safely slide into a base.

B. Statement of the Related Art

In the games of baseball and softball, a properly executed slide makes it more difficult for a position player manning a base to tag a runner. Sliding into the base is a necessary skill for any accomplished softball or baseball player; however, many young players are reluctant to learn the skill due to the fear of pain and injury. Conversely, a young player may injure him- or herself by attempting to slide without instruction and without the skills to execute a slide safely. For these reasons, youth softball and baseball coaches are reluctant to train players to slide or to even set aside regular time for sliding practice, yet players are expected to slide in games when sliding situations arise. This lack of time spent sliding is in stark contrast to the many hours players routinely spend practicing hitting, throwing and catching.

In a foot-first slide, a player sprints toward the base along the baseline and assumes the 'FIG. 4' position with one leg outstretched toward the bag and the knee of the other leg bent with the ankle of the second leg under the knee of the first leg. The player bends slightly at the waist and raises his or her head and hands. The player lands in front of the base on his or her bottom and second leg and slides in the dirt toward base. If the player is using proper form, the player's head and hands do not touch the ground.

The friction of the player's pants against the dirt slows the sliding player. If the player correctly gauges his or her initial speed and the rate of slowing during the slide, the player will stop while in contact with the base. If the player misjudges his or her speed, the player may stop short of the base or may slide past the base. If the player uses incorrect technique in the slide, the player may injure him or herself due to friction or impact.

Slide training apparatus are known in the art. U.S. Pat. No. 4,887,811 to Tresh issued Dec. 19, 1989, U.S. Patent Publication 2014/0051531 by Mazzocchi published Feb. 20, 2014 and the Schutt Slide-Rite 2.0 product marketed by Kranos Corporation, 710 South Industrial Drive, Litchfield, Ill. 62056 teach mats for slide training. The Schutt product is representative. The Schutt Slide-Rite 2.0 product utilizes a mat composed of fabric-covered foam to absorb the impact of a student landing on the mat. The Schutt Slide-Rite 2.0 foam is thick, at about 2.5 inches. The relatively deep penetration of the student into the Schutt foam causes substantial friction between the student and the Shutt mat, which reduces the slide of the student and may stop the slide prematurely. The thick foam is also bulky, and may present issues of storage and transportation.

The prior art does not teach the apparatus and method of the Invention.

II. BRIEF DESCRIPTION OF THE INVENTION

The apparatus of the Invention is an apparatus for teaching a baseball or softball player the safe and proper technique for sliding into a base. The apparatus comprises a resilient pad and a load-spreading member. The resilient pad is composed of a resilient material, such as open cell foam. The resilient pad absorbs the impact of a softball or baseball student, either small or large, landing on the mat.

The load-spreading member spreads the force of the student landing on the mat to a larger area and volume of the resilient pad than would be the case without the load-spreading member. The nature of open cell polymer foams is that the foam experiences nearly linear strain over a range of applied stress in compression. Because of the nearly linear stress/strain relationship of the open cell foam, the student landing on the load-spreading member on the resilient pad penetrates into the open cell foam less than would be the case without the load-spreading member. Because the student does not penetrate deeply into the foam on landing, use of the load-spreading member allows the thickness of the open cell foam to be less than would be the case without the load-spreading member. The open-cell foam also can be less dense and hence lighter and less expensive than would be the case without the load-spreading member.

The load-spreading member is disposed over all or a part of the top side of the resilient pad. The load-spreading member has a length and a width and is of at least an adequate size to transfer the force of the student landing on the load-spreading member to an adequate area and volume of the open cell foam to cushion the landing of the student and to prevent the student from fully crushing the open cell foam.

The resilient pad has a pad thickness, a crushed thickness and an expanded thickness. The 'pad thickness' is the thickness of the resilient pad normal to the top or bottom sides of the resilient pad. The 'crushed thickness' is the reduced thickness of the resilient pad when a force is applied to the pad normal to the top side of the resilient pad so that the pad will no longer experience resilient deformation in response to additional force. The 'expanded thickness' is the thickness of the resilient pad when the pad is not subjected to a force normal to the top of the resilient pad. Both the resilient pad and the load-spreading member have a stiffness, with the stiffness of the load-spreading member being greater than the stiffness of the resilient pad. The thickness and stiffness of the load-spreading member and of the resilient pad are selected so that the force applied by the student landing on the load-spreading member will compress the resilient pad to between the expanded thickness and the crushed thickness. The student landing on the load-spreading member will not compress the resilient pad to the crushed thickness. If the student misses the load-spreading member and lands directly on the resilient pad, the student may crush the resilient pad to the crushed thickness.

The apparatus of the Invention may include a base on the top side of the mat to provide a target for the student and to allow the student to gauge whether a slide is the correct distance or is long or short. The base may be removable and repositionable, as by hook-and-loop fasteners, to allow the student to learn different aspects of sliding technique and to practice different sliding scenarios.

In a first embodiment, the load-spreading member does not cover the entire top surface of the mat and instead defines a stripe in the longitudinal direction along the center of the top side of the resilient pad. The stripe defines the path along which the student will slide. The top side of the mat may define a frame into which the load-spreading member slides to releasably attach the load-spreading member to the mat. The frame holds the periphery of the load-spreading member. The surface of the load-spreading member is exposed through the frame. A fastener retains the load-spreading member in the frame. The resilient pad may feature a fabric cover between the resilient pad and the load-spreading member and the fabric of the fabric cover may define the frame.

To use the apparatus of the first embodiment, a user places a sliding sheet on top of the load-spreading member and on the mat at the location on which the student will land. The sliding sheet is separate from the mat and may be composed of any suitable material, such as cotton or synthetic sailcloth, polar fleece, terrycloth, woven or non-woven fabric, a calendared polymer or any other suitable flexible sheet material. The purpose of the sliding sheet is to prevent abrasion injuries to the student from sliding on the resilient pad and load-spreading member and to control the friction between the sliding sheet and the load-spreading member. The sliding sheet has a first side and a second side. The sliding sheet may exhibit a single material on both the first and second sides. Alternately, the sliding sheet may be composed of two different materials that are joined, as by sewing, so that the two opposing sides exhibit the two different materials. Where the sliding sheet exhibits two different materials, the user may select the sliding friction by selecting one of the sides of the sliding sheet on which to slide.

To use the Invention, the student will run in the longitudinal direction toward the mat and assume the figure-4 position. The student will land on the sliding sheet on the load-spreading member. The vertical force of the student landing on the load-spreading member causes both the load-spreading member and the resilient pad below the load-spreading member to resiliently deform, absorbing the impact and cushioning the student. The forward momentum to the student causes the student and the sliding sheet to slide on the load-spreading member in the longitudinal direction.

If the student is inaccurate in his or her aim and lands either wholly or partially off of the load-spreading member, the student will experience high friction from the resilient pad and thus slow very quickly. The student also may fully compress the resilient pad if the weight of the student lands off of the load-spreading member, causing the student a bump his or her bottom on the surface below the resilient pad. Because of the stress and strain characteristic of the foam, the student will nonetheless impact the surface below the pad with less force than if the resilient pad were not in place. Both of these events cause the student to quickly learn the importance of an accurate takeoff and landing.

While the student is sliding, the student is tempted put to his or her hands down for balance, which is not proper technique for safety. For the first embodiment, if the student puts his or her hands down while sliding, his or her hands will contact either the resilient pad or will contact the sliding sheet on top of the resilient pad. In either event, the friction caused by the student's hands or the sliding sheet will quickly slow the student, shortening the student's slide. The student quickly learns not to put his or her hands down.

For the first embodiment, a tough and durable fabric, such as a vinyl-covered fabric, woven nylon or other fabric or solid vinyl may cover the mat, including the resilient pad. The fabric may define a frame, open to the top side of the mat, configured to receive the load-spreading member and into which the load-spreading member slides. A strip of a suitable fastener, such as hook-and-loop fastener, may retain the load-spreading member in the frame. The frame covers the periphery of the load-spreading member and protects the student from possible injury caused by an edge defect that possibly may exist on the load-spreading member. The fabric frame also protects the student from a possible pinch injury if the student manages to place a finger between the resilient pad and the load-spreading member. The load-spreading member may extend for only a portion of the length of the mat because the student will not slide the entire length of the mat.

Rather than defining a frame, the fabric may cover the entire load-spreading member so that the sliding sheet slides on the fabric rather than on the load-spreading member.

The mat may be divided into sections that are hinged and that accordion-fold from an extended condition to a folded condition. In the folded condition, the sections are in a compact suitcase-shape for ease of carrying. Hook-and-loop fasteners, snaps, straps or any other suitable mechanism may retain the sections in the folded condition. Each of the sections has a width normal to the longitudinal axis of the resilient pad. The load-spreading member may be configured to have a length equal to or less than the width of the sections so that the load-spreading member may be stored between two of the sections when the sections are in the folded condition.

Alternative avenues to protect the student from edges of the load-spreading member include selecting a material for the load-spreading member that cannot have an edge defect, such as high-density foam. A second alternative is providing a load-spreading member that will not break to define edge defects and to blunt all edges of the load spreading member to eliminate edge defects. Another alternative is to protect the edges, as by burying the edges in the open-cell foam. Burying the edges in the open cell foam can also act to control the stiffness of the load-spreading member in the longitudinal direction, reducing movement of the mat in response to the friction of a sliding student.

The resilient pad optionally may include a second, denser resilient layer below the layer of open cell foam. The denser second resilient layer is selected so that the if the student misses the load-spreading member and lands on the resilient pad, or if the student otherwise fully compresses the open cell foam layer, then the downward motion of the student will be arrested by the denser second resilient layer rather than by a hard surface on which the pad rests.

A second embodiment of the Invention may include the load-spreading member extending the entire length of the resilient pad along the longitudinal axis. The resilient pad and the load-spreading member may be covered by the durable and abrasion-resistant fabric so that the student will slide on the fabric rather than on the load-spreading member.

A third embodiment of the Invention is similar to the second embodiment except that the load-spreading member covers the entire top side of the resilient pad, from edge to edge. Providing that the load-spreading member covers the entire top side of the resilient pad means that the student will slide wherever the student lands on the sliding mat and is not limited to a stripe down the center. Covering the entire top side of the resilient pad with the load-spreading member also means that the edges of the load-spreading member are widely separated and the student is unlikely to encounter any edge defects of the load-spreading member that may exist. Covering the entire top side also improves the stability of the apparatus because the mat has even less tendency to bunch and to be pulled along behind the student as he or she slides. The tough and durable fabric layer may cover the resilient pad or both the load-spreading member and resilient pad of the third embodiment. The fabric covering of the third embodiment further separates the student from any edge defects of the load-spreading member, providing addition safety to the student.

For each of the embodiments, the mat may be hinged to allow the mat to fold from and extended position to a folded position having a compact size for storage and transportation. Three or four sections that accordion-fold are believed to be suitable. As an alternative to the single, un-hinged load-spreading member of the first embodiment, separate load spreading member portions may be attached to some or all of the folding sections. At the intersection between the adjacent sections, the downstream load-spreading member portion will be sloped to well below the elevation of the adjacent upstream load-spreading member portion so that the weight of the sliding student will pass smoothly from one section and from one load-spreading member portion to the next. The sloping downstream load-spreading member eliminates the possibility that the sliding student might run into the end of the downstream load-spreading member portion. The load-spreading member portions may not extend along all of the sections because the student will not slide for the entire length of the mat.

For each of the embodiments, the sections may be of different thicknesses. For example, a first section may be the designated landing location for the student, who will then slide across the second section to the target base located on the third (or a fourth) section. Only the resilient pad of the first section need be adequate to absorb the force of the landing student. The second, third and fourth sections need provide only minimal cushioning to the student as the student slides on those sections. As an alternative, the second section also may feature resilient pads that will absorb the force of the landing student who misses the first section while the third and fourth sections provide minimal cushioning.

For the second and third embodiments, the resilient pad and the load-spreading member are attached one to the other by any suitable mechanism, such as by an adhesive or by stitching. The load-spreading member may be retained in position on the resilient pad by the fabric covering, avoiding the use of adhesive, stitching or other attachment mechanism.

For each of the embodiments, the thickness and the stiffnes of the open cell foam in compression may be selected so that if a baseball or softball player practicing a slide were to land on the resilient pad without the load-spreading member, the player's body would compress the pores of the open cell foam completely to the crushed thickness and allow the downward motion of the player's body to be stopped by the surface underneath the open cell foam. By including the load-spreading member, each of the embodiments prevents that occurrence and transfers the force of the student's landing to an adequately large area and volume of open cell foam so that the student's downward motion is stopped by the open cell foam and not by the surface supporting the open cell foam.

For each of the embodiments, the resilient pad may include a second denser resilient layer to arrest the downward motion of the student in the event that the student, particularly a large and heavy student, fully compresses a less-dense layer during landing.

III. BRIEF DESCRIPTION OF THE DRAWINGS

FIG. 1 is a perspective view of a first embodiment of the Invention.

FIG. 2 is a perspective view of the load-spreading member of the first embodiment.

FIG. 3 is a detail sectional view of the mat.

IV. DESCRIPTION OF AN EMBODIMENT

Figure 4:
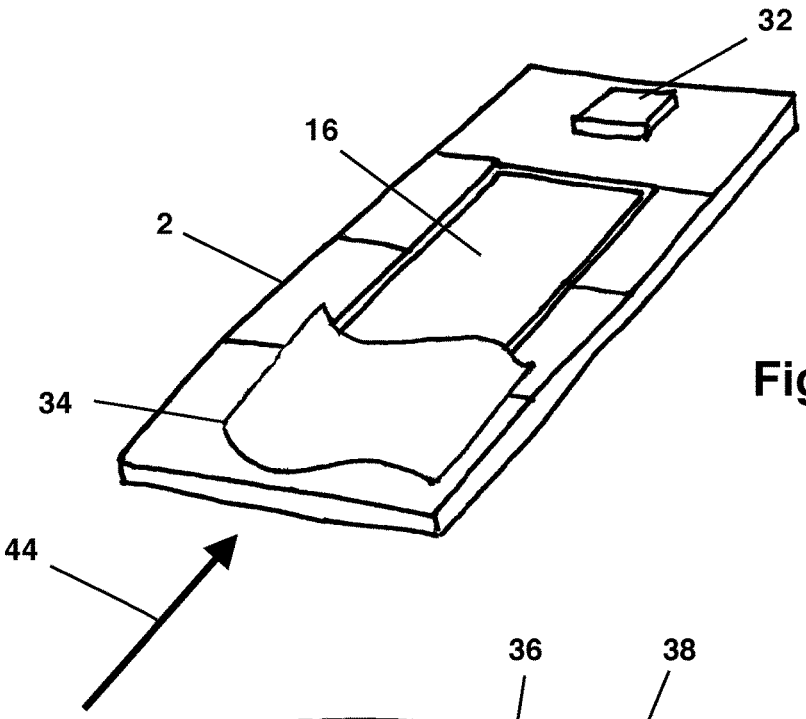
FIG. 4 is perspective view of the first embodiment with the load-spreading member and sliding sheet ready for use.

FIGS. 1 through 6 illustrate a first embodiment of the Invention. FIG. 1 shows a mat 2 having four sections 4. The mat defines a first end 6 and a second end 8. The mat 2 also defines a top side 10 and a bottom side 12. From FIG. 3, the mat 2 is a resilient pad 24 and includes a layer of a resilient material 26, such as open cell foam 28. A durable, abrasion-resistant fabric 18 may provide a cover 20 for the mat 2. Vinyl-covered woven fabric having a weight of 18 ounces/yard has proven suitable in practice as the abrasion-resistant fabric 18.

From FIG. 1, the top side 10 of the mat 2 defines a frame 14, shown in detail cross section in FIG. 3. The frame 14 is configured to receive and retain a load-spreading member 16, shown by FIG. 2. The load-spreading member 16 selectably slides into the frame 14 from the mat first end 6. A fastener 22, such as a hook-and-loop fastener, selectably retains the load-spreading member 16 in place on the mat top side 10. The frame 14 retains the load-spreading member 16 in place during use of the Invention. As shown by FIG. 3, abrasion-resistant fabric 18 may be attached to the cover 20 to define the frame 14. Any suitable attachment mechanism may attach the frame 14 to the cover 20, such as stitching or adhesive.

As noted above, the purpose of the load-spreading member 16 is to support a student landing on the load-spreading member 16 and to spread the impact of the landing student to a relatively large area of the resilient material 26. The use of the load-spreading member 16 allows use of a thinner, lighter and hence less expensive resilient material 26, such as open cell foam 28, than would otherwise be the case without the use of the load-spreading member 16. Exposure of the relatively slippery load-spreading member 16 on the top side 10 of the mat 2 also allows a lower coefficient of kinetic friction between the sliding sheet 34 and the mat 2, allowing an inexperienced student to slide more easily than would otherwise be the case.

The load-spreading member 16 is a relatively thin and relatively stiff solid polymer such as poly(methyl methacrylate), polyethylene, polypropylene, polycarbonate, polystyrene, fiber-reinforced resin, or any other suitable material that is selected to be relatively thin compared to its length and width, relatively stiff, resilient in flexure, impact resistant, and to transfer the impact load to the resilient pad 24. Corrugated plastic sheet 30 composed of polypropylene that is 3/16 inches (4 mm) in thickness and with a weight of approximately 700 grams/square meter has proven suitable in practice for the load-spreading member 16. The corrugated plastic sheet 30 features polypropylene top and bottom layers and has polypropylene webs interposed between the top and bottom layers. Suitable corrugated plastic sheets 30 are available from Boxforless.com, of 6836 Lankershim Blvd., North Hollywood, Calif. 91605.

A base 32 is disposed on the mat top side 10 at the mat second end 8. The base 32 mimics the appearance of a baseball or softball base and provides the student with a sliding target. The base 32 can be moved to different locations on the mat top side 10 at the mat second end 8 to allow the student to practice different sliding scenarios. The base 32 is releasably attachable to the mat top side 10 by any suitable mechanism, such as hook-and-loop fasteners.

Figure 5:
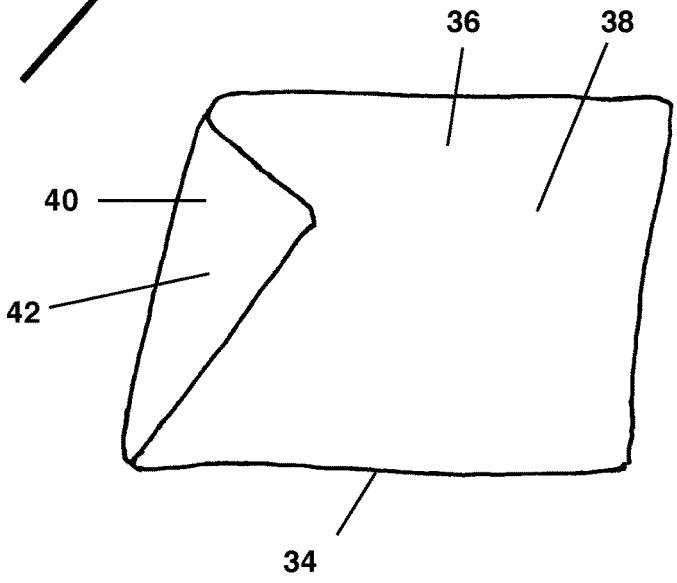
FIG. 5 is a plan view of the sliding sheet showing the first and second sides.

To use the Invention, a student runs in the longitudinal direction 44, shown by FIG. 4, assumes the figure-4 position and lands on a sliding sheet 34 that is on top of the mat 2. FIGS. 4 and 5 show the sliding sheet 34. The sliding sheet 34 has a first side 36 and a second side 40. The sliding sheet 34 may display the same material on the first and second sides 36, 40. Alternatively, the sliding sheet 34 may display a first material 38 on the first side 36 and a second material 42 on the second side 40. The choice of materials for the first and second sides 36, 40 affects the coefficient of kinetic friction between the sliding sheet 32 and the load-spreading member 16 when the student is on the sliding sheet 34 and the sliding sheet 34 is sliding on the load-spreading member 16.

Where the sliding sheet has two different materials 38, 42, the first side 36 of the sliding sheet 34 has a first material 38 that is relatively slippery and that results in a relatively low coefficient of kinetic friction when a student is on the sheet 34 and the first side 36 of the sheet 34 is sliding on the load-spreading member 16. The relatively slippery material of the first side 36 of the sliding sheet 34 allows the student to slide easily on the mat 2.

The second side 40 of the sliding sheet 34 exhibits a second material 42 resulting in a higher coefficient of kinetic friction when the student is on the sliding sheet 34 and the second side 40 of the sliding sheet 34 is sliding on the load-spreading member 16. The second material 42 is selected to approximate the higher friction experienced by the student sliding into an actual base on the dirt of an actual baseball or softball diamond A sliding sheet 34 with the first side 36 composed of polyester polar fleece and the second side 40 composed of cotton terrycloth has proven suitable in practice where the load-spreading member 16 is composed of corrugated plastic 30 as described above on a mat 2 having a resilient pad 24 of open cell foam 28 that is 1.5 inches thick. The polyester polar fleece, a soft-napped insulating fabric, provides a relatively low coefficient of kinetic friction. The cotton terrycloth provides a relatively high coefficient of kinetic friction. For a two-sided sliding sheet 34, a user can select a higher or lower coefficient of kinetic friction by selecting which side 36, 40 of the sliding sheet 34 is against the load-spreading member 16.

The Inventor conducted experiments to determine appropriate coefficients of kinetic friction between the sliding sheet 34 and the mat 2. The inventor prepared a test mat having a resilient pad composed of open cell foam that is 1.5 inches thick and enclosed in a cover composed of an abrasion-resistant vinyl-covered fabric of 18 ounces per square yard in weight. The Inventor secured a load-spreading member 16 to the mat 2. The load-spreading member 16 was composed of 4 mm thick corrugated plastic 30, as described above. The Inventor determined that the combination of load-spreading member 16 and mat 2 to be suitable for the purpose and to adequately cushion students of different weights landing on the load-spreading member 16 and mat 2. The Inventor secured the load-spreading member 34 of corrugated plastic 30 to the mat 2 using a frame 14, as described above. After experimentation, the Inventor determined that a sliding sheet 34 exhibiting a first side 36 of polar polyester polar fleece provided a suitable low sliding friction to allow an inexperienced student to easily slide while learning sliding technique. After experimentation, the Inventor determined that a sliding sheet 34 exhibiting a second side 40 of cotton terrycloth exhibited an adequately high sliding friction to adequately mimic the friction that a baseball or softball player would experience when sliding into an actual base in the dirt on an actual baseball or softball diamond. The Inventor then derived the coefficients of kinetic friction for each of those combinations. The following table presents the results of that derivation:

| Subject | Weight (lbs.) | Force (N) | Force (lbs.) | sliding sheet material | μ = F/W |
|---|---|---|---|---|---|
| 1 | 77.2 | 130.92 | 29.43 | first | 0.381 |
| 2 | 49.4 | 83.5 | 18.77 | first | 0.380 |
| 3 | 153 | 251.34 | 56.5 | first | 0.369 |
| 1 | 77.2 | 165.9 | 37.29 | second | 0.483 |
| 2 | 49.4 | 97.98 | 22.03 | second | 0.446 |
| 3 | 153 | 282.56 | 63.52 | second | 0.415 |

Where:

a) the subject identifies the human test subject, b) the weight is the measured weight of the human test subject, c) the force (N) is the measured force in newtons required to maintain sliding movement of the sliding sheet 34 along the load-spreading member 16 on the mat 2 with the human test subject on the sliding sheet 34, d) the force (lbs.) is the force (N) converted to pounds, e) the sliding sheet 34 material 38, 42 is the material in sliding engagement with the load spreading member 16. The first material 38 is polyester polar fleece. The second material 42 is cotton terrycloth.

e) μ is the coefficient of kinetic friction and in this instance is the dimensionless ratio of the force (lbs.) to the weight (lbs.).

From these data, the Inventor concludes that an acceptable value for the coefficient of kinetic friction between the low-friction first material 38 and the mat 2 is less than or equal to 0.39. Any combination of materials and configurations of materials that results in a coefficient of kinetic friction of less than or equal to 0.39 will allow an inexperienced student to easily and safely slide while learning proper technique. The Inventor also concludes that from these data an acceptable value for the coefficient of kinetic friction between the high-friction second material 42 and the mat is greater than 0.39. Any combination of materials and configurations of materials that results in a coefficient of kinetic friction of greater than 0.39 will adequately approximate the friction that the student will experience when sliding into an actual base on an actual baseball or softball diamond.

Any configuration for the sliding sheet 34, mat 2, abrasion-resistant fabric 18, load-spreading member 16, resilient pad 24, and thickness of the resilient pad 24, that result in coefficients of sliding friction within the indicated ranges are contemplated by the Invention.

Figure 6:
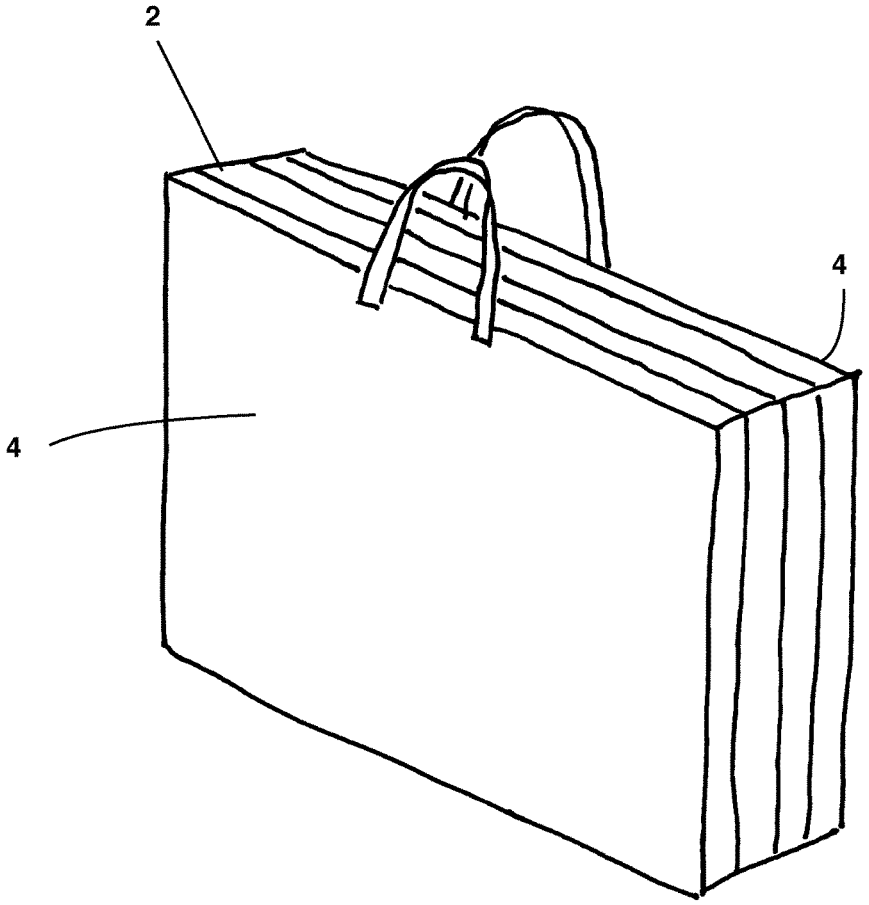
FIG. 6 is a perspective view of the first embodiment in a folded condition.

FIG. 6 illustrates that the sections 4 of the mat 2 fold to a suitcase-shape that is readily transportable and storable. The size of the load-spreading member 16 is equal to or less than the size of one of the sections 4 and so the load-spreading member 16 may be carried and stored between two adjacent folded sections 4 without extending beyond the edges of the folded sections 4. The sections 4 may be retained in the folded condition by any suitable mechanism, such as hook-and-loop fasteners, snaps, straps, or any other mechanism known in the art. FIG. 6 shows four sections 4 of the first embodiment, but the mat 2 may utilize any number of sections 4, including one, two, three or more sections 4.

Figure 7:
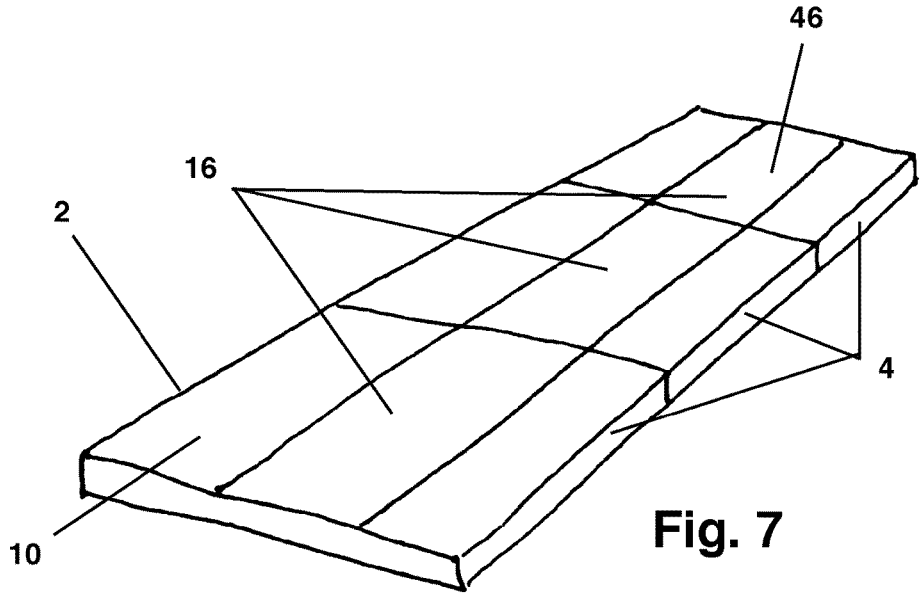
FIG. 7 is a perspective view of a second embodiment.
Figure 8:
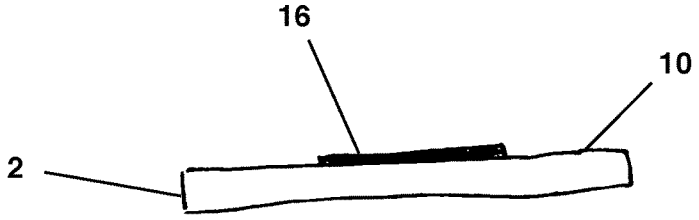
FIG. 8 is an end view of the second embodiment.
Figure 9:
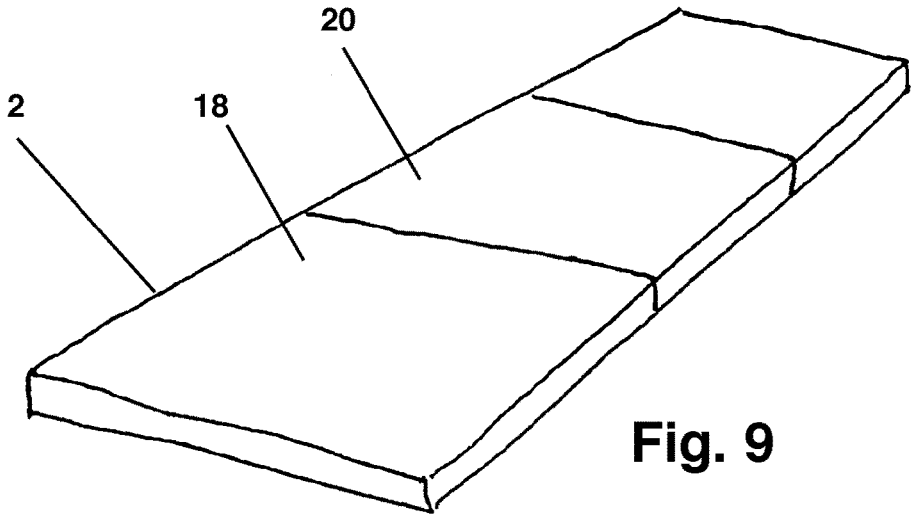
FIG. 9 is a perspective view of the second embodiment having a fabric cover.
Figure 10:
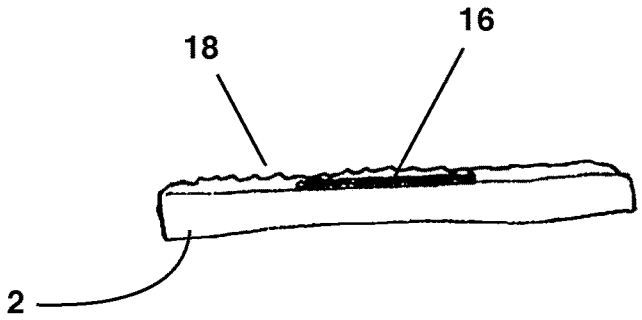
FIG. 10 is an end view of the embodiment of FIG. 9.

FIGS. 7 through 10 illustrate a second embodiment of the Invention. In the second embodiment as shown by FIGS. 7 and 8, the load-spreading member 16 extends in a stripe 46 the length of the mat 2 and is exposed on the top side 10 of the mat 2. In a modification of the second embodiment as shown by FIGS. 9 and 10, the top side 10 of the mat 2, including the load-spreading member 16 is inside the cover 20 defined by the abrasion-resistant fabric 18. A student using the second embodiment of FIGS. 9 and 10 will slide on the abrasion-resistant fabric 18 rather than the load-spreading member 16. In other respects, the mat 2 of the second embodiment of FIGS. 7-10 functions in the same manner as the first embodiment.

Figure 11:
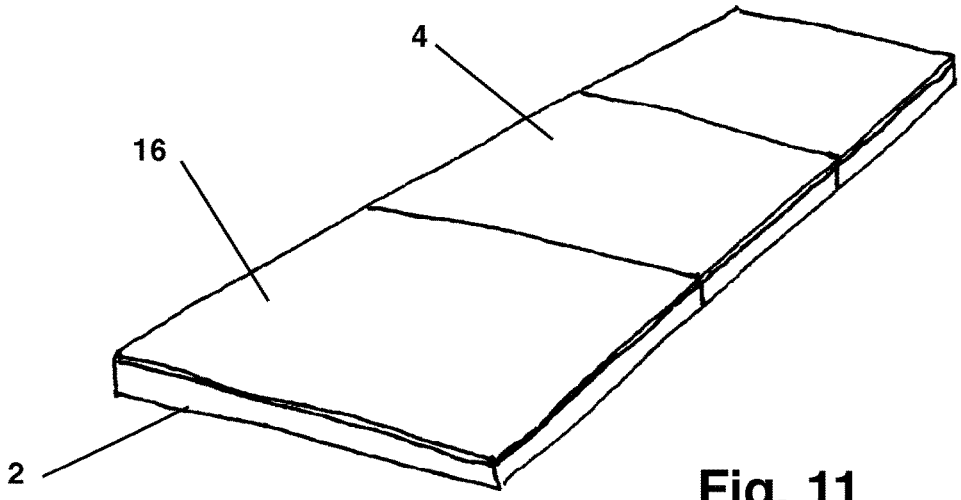
FIG. 11 is a perspective view of a third embodiment.
Figure 12:
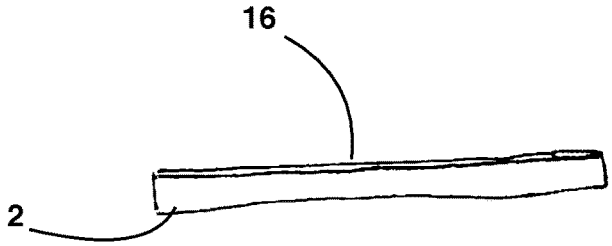
FIG. 12 is an end view of the embodiment of FIG. 11.
Figure 13:
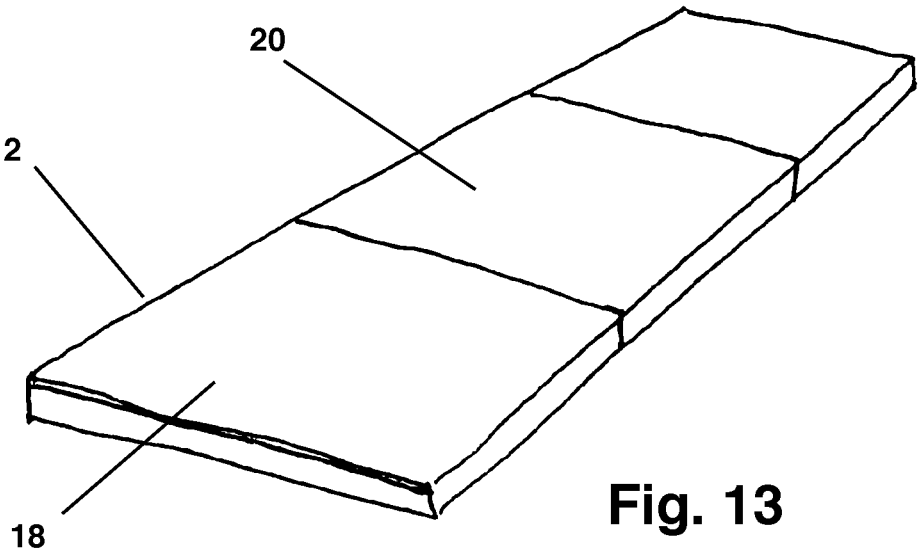
FIG. 13 is a perspective view of the embodiment of FIG. 11 with a fabric cover.
Figure 14:
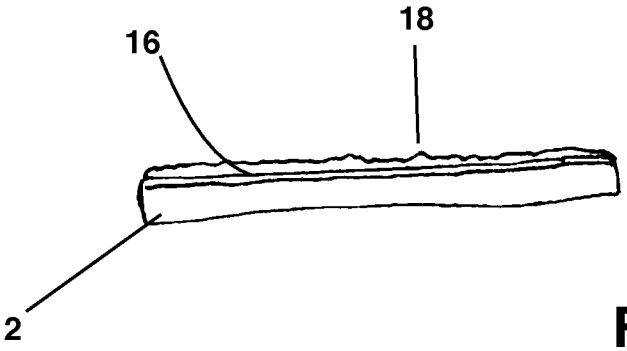
FIG. 14 is an end view of the embodiment of FIG. 13.

FIGS. 11-14 show a third embodiment. In the third embodiment, the load-spreading member 16 extends from edge-to-edge on the mat 2. FIGS. 11 and 12 illustrate the load-spreading member 16 as extending the full length of the mat 2, but the load-spreading member may extend less than the full length. Providing the load-spreading member 16 that extends edge to edge reduces the consequences to the student of missing a narrower load-spreading member 16. Alternatively, the width of the mat 2 may be reduced to make the mat 2 more compact and easier to store and transport. FIGS. 13 and 14 show that the mat 2, including the load-spreading member 16, may be enclosed within the cover 20 composed of the abrasion-resistant fabric 18. In the instance of FIGS. 13 and 14, the sliding sheet 34 will slide on the abrasion-resistant fabric 18 rather than on the load-spreading member 34.

Figure 15:
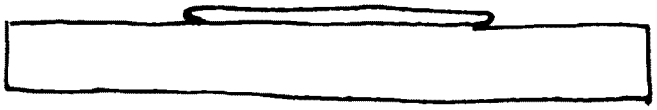
FIG. 15 is an end view of a load spreading member having exposed edges.
Figure 16:
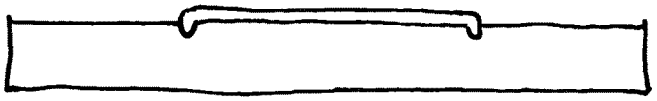
FIG. 16 is an end view of the load-spreading member having edges with a first configuration.
Figure 17:
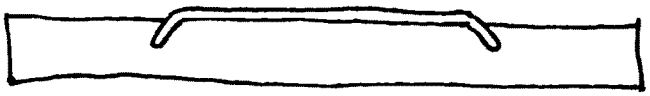
FIG. 17 is an end view of the load-spreading member having edges with a second configuration.

For the second and third embodiments, the load-spreading member 16 is in one or more portions that cooperate to define the entire load-spreading member 16 when the sections 4 of the mat 2 are unfolded. As a result, the portions of the load-spreading member 16 stay with the sections 4 with which they are associated. FIGS. 15, 16 and 17 illustrate configurations of the load-spreading member 16 to reduce the likelihood that a student may come in contact with an imperfection in the edge of a load-spreading member 16 when sliding on the mat 2. FIG. 15 illustrates a load-spreading member 16 that is exposed on the top side of the mat 2 and that is configured so that the edges of the load-spreading member 16 cannot define an imperfection, such as by selecting a closed-cell foam for the load-spreading member 16 or by rounding the edges of the load-spreading member 16. FIG. 16 shows that the edges of the load-spreading member 16 may be oriented downward and buried in the resilient pad 24. FIG. 17 is similar to FIG. 16 and shows a different configuration of the edges of the load-spreading member 16 and the resilient pad 24 so that a student cannot come in contact with the edges of the load-spreading member 16.

In the second and third embodiments of FIGS. 7-14 and 18-21, the load-spreading member 16 is divided into portions 48 and each portion 48 may remain attached to its respective section 4 when the mat 2 is folded. As a result, when the mat 2 is in the extended condition there is an intersection between adjacent portions 48 of the load-spreading member 16. The intersection of the adjoining load-spreading member portions 48 is configured so that the sliding student will not run into the end of a portion 48 of the load-spreading member 16 as the student slides from one section 4 to the next.

Figure 18:
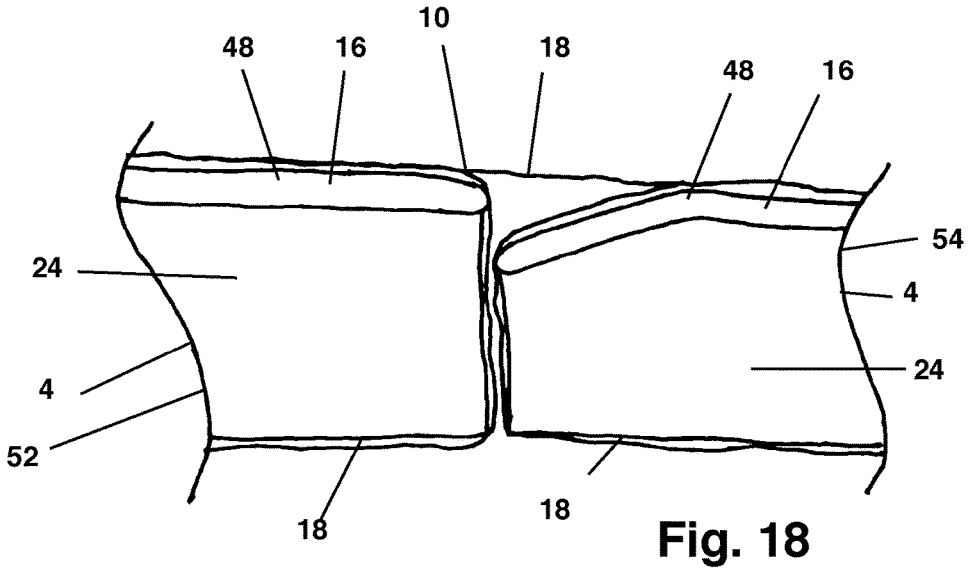
FIG. 18 is a detail sectional side view of a joint between a first and a second section having separate load-spreading members.
Figure 19:
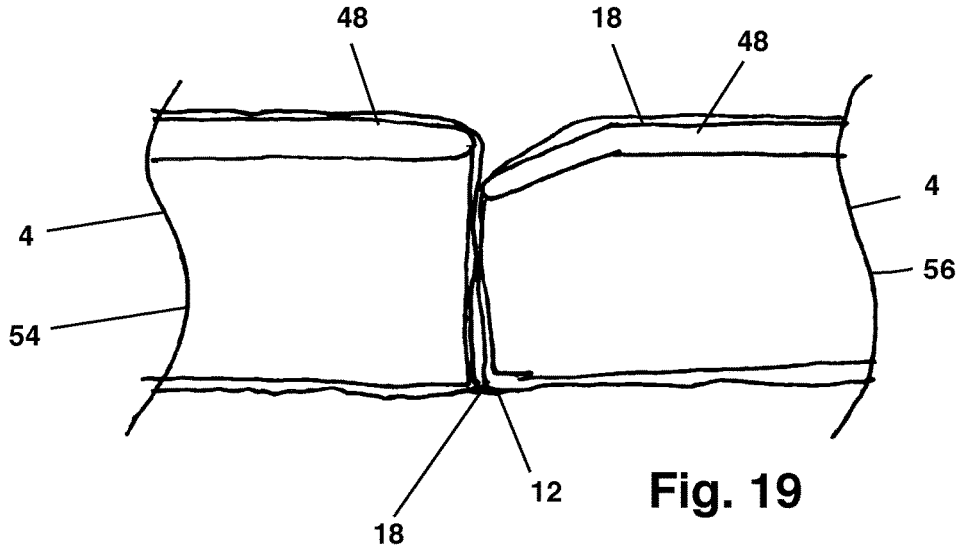
FIG. 19 is a second detail sectional side view of a junction between the second section of FIG. 19 and a third section having separate load-spreading members.

FIGS. 18-21 illustrate configurations to prevent the sliding student from running into the end of a load-spreading member portion 48. FIGS. 18 and 19 show the junctions between a first 52, second 54 and third 56 sections 4 of a three-section mat 2. FIG. 18 shows two adjacent sections 4 that are hinged at the top side 10 by the abrasion-resistant fabric 18. The thickness of the resilient pad 24 of the second section 54 is reduced at the junction between the two sections 52, 54 so that the sliding student will pass smoothly from the first section 52 to the second section 54 and from the upstream portion 48 of the load-spreading member 16 to the downstream portion 48. FIG. 19 shows the junction between the second section 54 of FIG. 18 and the third section 56. FIG. 19 is similar to FIG. 18, except that the hinge between the adjacent sections 4 is on the bottom side 12. To accordion fold, adjacent sections 4 are hinged on alternating sides.

Figure 20:
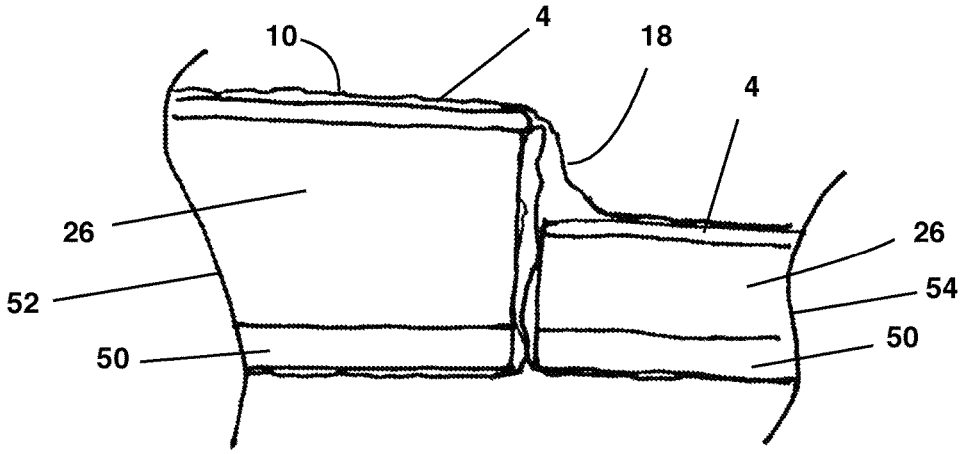
FIG. 20 is a detail sectional view of a joint between a first and a second section having different thicknesses.
Figure 21:
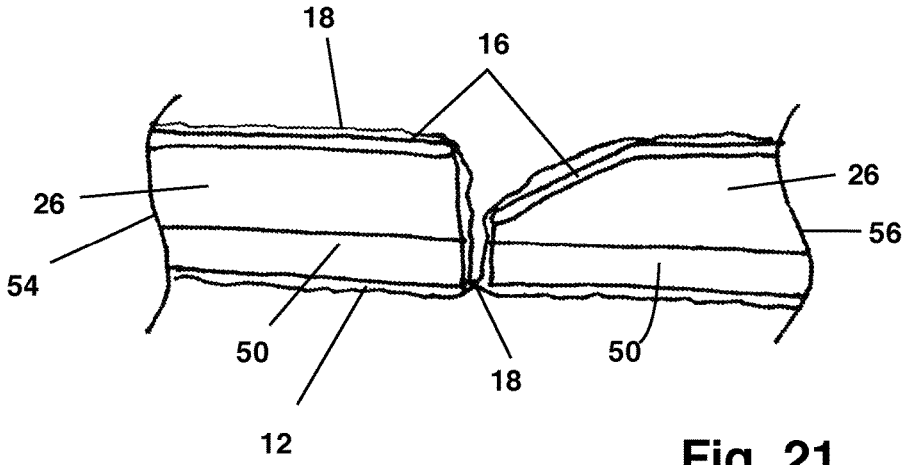
FIG. 21 is a detail sectional view of a joint between the second section of FIG. 20 and a third section.

FIGS. 20 and 21 also show the junctions between a first 52, second 54 and third 56 section 4 of a three-section mat 2. FIG. 20 illustrates that different sections 4 may have different thicknesses. FIG. 20 shows a first section 52 that is thicker than the second section 54. The student will land on the first section 52, which may be thicker to absorb the impact. The second and third sections 54, 56 may be thinner because those sections are only required to support the student while he or she is sliding. FIG. 20 also shows that if the adjoining sections 52, 54 differ in thickness then the second section 54 may not require height compensation for the load-spreading member 16 to avoid the sliding student running into the edge of the load-spreading member portion 48.

FIGS. 20 and 21 also illustrate that the resilient pad may be composed of more than one material, in this instance the first resilient material 26 and a second resilient layer 50. The second resilient layer 50 cooperates with the resilient material 26 to define the resilient pad 24. The second resilient layer 50 may be selected to be relatively stiff so that if a student fully compresses the first resilient material 26 on landing, the impact of the student is nonetheless cushioned by the second resilient layer 50 rather than stopped by an unyielding floor or other hard surface below the mat 2.

FIG. 20 and FIG. 21 also show that adjacent sections 52, 54, 56 are hinged on alternating sides, with the first and second sections 52, 54 of FIG. 20 hinged at the top side 10 and the second and third sections 54, 56 of FIG. 12 hinged at the bottom side 12. As noted above, to successfully accordion fold, adjacent sections 4 are hinged on alternating sides 10, 12.

The following is a list of the numbered elements.

Mat 2
Mat section 4
Mat first end 6
Mat second end 8
Mat top side 10
Mat bottom side 12
Frame 14
Load-spreading member 16
Abrasion-resistant fabric 18
Cover 20 for the mat
Fastener 22
Resilient pad 24
Resilient material 26
Open cell foam 28
Corrugated plastic sheet 30
Base 32
Sliding sheet 34
First side 36
First material 38
Second side 40
Second material 42
Longitudinal direction 44
Stripe 46
Portion 48 of the load-spreading member 16
Second layer 50 of the resilient pad 24
First section 52
Second section 54
Third section 56

I claim:

1. A baseball and softball sliding training apparatus for use by a student in learning to run toward a base, to assume a sliding position, to land on a ground in the sliding position and to slide to the base, the apparatus comprising:

a. a load-spreading member, said load-spreading member defining a sheet having a length and a width, said load-spreading member being elongated in a longitudinal direction to define said length, said load-spreading member being configured to receive the student landing in the sliding position on said load-spreading member;

b. a resilient pad configured to support said load-spreading member on a top side of said resilient pad, said resilient pad and said load-spreading member having a configuration to resiliently support the student landing on said load-spreading member without crushing said resilient pad, said resilient pad having a configuration not to resiliently support the student landing on said resilient pad without crushing said resilient pad in an absence of said load-spreading member, said load spreading member being attachable to said resilient pad so that said load spreading member is disposed within a periphery of said resilient pad;

c. a sliding sheet, said sliding sheet being configured for a sliding engagement with said load-spreading member and said resilient pad when said load spreading member is attached to said resilient pad.

2. The apparatus of claim 1 wherein each of said load-spreading member and said resilient pad has a stiffness, said stiffness of said load-spreading member is greater than said stiffness of said resilient pad.

3. The apparatus of claim 2 wherein said configuration of said resilient pad and said load-spreading member to resiliently support said student comprises: said resilient pad defining a pad thickness, said pad thickness defining a crushed thickness and an expanded thickness, said crushed thickness being said pad thickness below which said resilient pad generally cannot be resiliently compressed by a force acting normal to said top side of said resilient pad, said expanded thickness being said pad thickness when said force is not acting normal to said direction normal to said top side, said stiffness of said load-spreading member and said stiffness of said resilient pad and said pad thickness being selected so that said resilient pad is compressed to between said expanded thickness and said crushed thickness when the student lands in the sliding position upon said load-spreading member.

4. The apparatus of claim 3 wherein said configuration of the resilient pad not to resiliently support the student landing on said resilient pad in an absence of said load-spreading member comprises: said stiffness of said resilient pad and said pad thickness are selected so that said resilient pad may be compressed to said crushed thickness when the student lands upon said resilient pad and does not land upon said load-spreading member.

5. The apparatus of claim 1 wherein said resilient pad has a configuration to selectably receive and retain said load-spreading member on said top side of said resilient pad.

6. The apparatus of claim 5 further comprising:

a. a cover disposed on said resilient pad;

b. a frame attached to said cover, said frame defining said configuration of said resilient pad to selectably receive and retain said load-spreading member, said frame being disposed about a periphery of said load-spreading member when said load-spreading member is received and retained by said resilient pad, said frame being open on a first end of said resilient pad;

c. a fastener disposed at said first end of said resilient pad, said fastener being configured to secure said load-spreading member within said frame.

7. The apparatus of claim 6 wherein said load-spreading member defines a surface, said surface of said load-spreading member is exposed when said load-spreading member is retained by said frame and said fastener.

8. The apparatus of claim 1 wherein said load-spreading member defines a surface, said surface being exposed when said resilient pad is supporting said load-spreading member, the apparatus further comprising: said sliding sheet having a first side, said first side of said sliding sheet being configured for a sliding engagement with said surface of said load-spreading member, said first side of said sliding sheet and said load-spreading member and said resilient pad being configured so that said sliding engagement has a coefficient of kinetic friction of less than or equal to 0.39 when a weight of the student is on the sliding sheet and said first side of said sliding sheet is sliding on said surface of said load-spreading member.

9. The apparatus of claim 8 wherein said sliding sheet has a second side, said second side of said sliding sheet being configured for said sliding engagement with said surface of said load-spreading member, said second side of said sliding sheet and said load-spreading member and said resilient pad being configured so that said sliding engagement has a coefficient of kinetic friction of greater than 0.39 when said weight of the student is on the sliding sheet and said second side of said sliding sheet is sliding on said surface of said load-spreading member.

10. The apparatus of claim 1 wherein said resilient pad defines a plurality of sections, said plurality of sections being in hinged engagement, said resilient pad defining an extended condition and a folded condition, said resilient pad being configured to support said load-spreading member when said resilient pad is in said extended condition, said load-spreading member defining a single portion, said load-spreading member not being defined by a plurality of portions.

11. The apparatus of claim 10 wherein each of said plurality of sections has a section width normal to a longitudinal axis of said resilient pad when said resilient pad is in said extended condition, said length of said load-spreading member being less than or equal to said section width, whereby said load-spreading member may be stored between two of said plurality of sections when said resilient pad is in said folded condition.

12. The apparatus of claim 10 wherein said load-spreading member spans at least two of said sections when said resilient pad is in said extended condition and said load-spreading member is supported by said resilient pad.

13. The apparatus of claim 12, the apparatus further comprising: a target base, said resilient pad having a first end and a second end, said target base being releasably attachable to said second end, said target base resembling a baseball or a softball base, whereby said target base provides the student with a sliding target.

14. The apparatus of claim 11 wherein said resilient pad has a pad width transverse to said longitudinal axis, said pad width being greater than said width of said load-spreading member, whereby if the student places the student's hands on the apparatus while sliding on the load-spreading member the student may engage the resilient pad.

15. The apparatus of claim 1, further comprising: a fabric cover, said fabric cover being disposed on a top side of said load-spreading member and said resilient pad, whereby the student sliding on the apparatus may touch said fabric cover but will not touch said load-spreading member or said resilient pad.

16. The slide trainer of claim 10 wherein said sections comprise: a first section, a second section, a third section, and a fourth section each of said sections having a top side and a bottom side, said first and second sections having said hinged connection disposed at said top side of said first and second sections, said second and third sections having said hinged connection disposed at said bottom side of said second and third sections, said third and said fourth sections having said hinged connection disposed at said top side of said third and fourth sections whereby said resilient pad will accordion fold between said folded position and said extended position.

17. The slide trainer of claim 10 wherein said sections comprise: a first section, a second section, a third section, and a fourth section each of said sections having a top side and a bottom side, said first and second sections having said hinged connection disposed at said bottom side of said first and second sections, said second and third sections having said hinged connection disposed at said top side of said second and third sections, said third and said fourth sections having said hinged connection disposed at said bottom side of said third and fourth sections whereby said resilient pad will accordion fold between said folded position and said extended position.

* * * * *